United States Patent [19]

Kerby

[11] 4,217,189

[45] Aug. 12, 1980

[54] METHOD AND APPARATUS FOR CONTROL OF ELECTRO-WINNING OF ZINC

[75] Inventor: Robert C. Kerby, Rossland, Canada

[73] Assignee: Cominco Ltd., Vancouver, Canada

[21] Appl. No.: 52,921

[22] Filed: Jun. 26, 1979

[30] Foreign Application Priority Data

Jul. 5, 1978 [CA] Canada ..... 306805

[51] Int. Cl.[2] ..... C75C 1/16

[52] U.S. Cl. ..... 204/119; 204/1 T

[58] Field of Search ..... 204/1 T, 119

[56] References Cited

U.S. PATENT DOCUMENTS 3,798,147 3/1974 Higashiyama et al. ..... 204/1 T

*Primary Examiner*—R. L. Andrews

*Attorney, Agent, or Firm*—Wenderoth, Lind & Ponack

[57] ABSTRACT

A method is disclosed for controlling a process for the recovery of zinc from zinc sulfate electrowinning solutions containing concentrations of impurities. The disclosed method includes the steps of establishing a test circuit comprising a test cell, a sample of electrowinning solution, a cathode, an anode and a reference electrode immersed in said sample, a variable voltage source and measuring means electrically connected to the electrodes. A potential is applied to the electrodes in the test cell to obtain a predetermined potential between the cathode and the reference electrode. The potential is decreased from the predetermined value at substantially zero current, the decreasing potential is measured, and the decreasing of the potential is terminated at a value corresponding to the point at which zinc starts to deposit on the cathode and the measured electrode current density increases rapidly from a value of substantially zero for further small decreases in potential. The activation over-potential is determined and is related to the concentration of impurities in the sample, whereupon the process for the recovery of zinc is adjusted to obtain optimum zinc recovery.

24 Claims, No Drawings

METHOD AND APPARATUS FOR CONTROL OF ELECTRO-WINNING OF ZINC

BACKGROUND OF THE INVENTION

This invention relates to a method and apparatus for controlling the electrodeposition process of zinc and, more particularly, to a method for controlling the purification of zinc sulfate electrowinning solutions and the zinc electrowinning process by measuring the activation over-potential which is a measure of the solution purity and of the ratio of concentration of polarizing additive to concentration of impurities in zinc sulfate electrolyte, and an apparatus to carry out the method.

In the process for electrowinning zinc from zinc sulfate solutions impurities such as antimony, germanium, copper, nickel, cobalt, iron, cadmium and lead, when present above certain critical concentrations, cause resolution of deposited zinc and a corresponding decrease in the current efficiency of the zinc deposition. To reduce the concentration of impurities in electrolyte to the desired low levels, thereby to reduce these effects to a minimum, a complex purification procedure, which generally includes an iron precipitation and a zinc dust treatment, is employed prior to electrolysis. In addition to the purification, polarizing additives such as glue are added to the electrolyte to reduce the effects of the remaining impurities, as well as to provide smooth and level deposits, and, to some extent, to control acid mist evolution.

The procedures presently used for determining the purity of electrolyte are based on chemical analyses and determinations of current efficiencies as a measure of impurity content, while those for the additions of polarizing additive such as animal glue and the like are based on maintaining a constant concentration of additive in the electrolyte despite variations in the concentration of impurities. These procedures result in variations in the quality of the deposited zinc and the current efficiency of the electrowinning process. A more desirable system would be to control the purification process and, in the electrowinning process, to control the additive concentration in the electrolyte relative to the impurity concentration. These controls would result in a reduction of the effects of impurities with a corresponding increase in the current efficiency of zinc production.

PRIOR ART

The prior art contains a number of references related to methods for determining the effects of impurities, glue and other addition agents on electrodeposition processes for metals and for determining the purity of zinc sulfate solutions. These methods are generally based on determining relationships between currents, or current densities, and voltages during the deposition of metal, or on determining current efficiencies as related to gas evolution or metal deposition and dissolution during electrolysis.

According to U.S. Pat. No. 3,925,168, L. P. Costas, Dec. 9, 1975, there is disclosed a method and apparatus for determining the content of colloidal material, glue or active roughening agent in a copper plating bath by determining the over-potential-current density relationships of solutions having varying known reagent content and comparing the results with that of a solution with a known plating behaviour and roughening agent content. According to Canadian Pat. No. 988,879, C. J. Krauss et al, May 11, 1976, there is disclosed a method for determining and controlling the cathode polarization voltage in relation to current density of a lead refinery electrolyte, wherein the slope of the polarization voltage-current density curves is a measure of the amount of addition agents and wherein the effectiveness of addition agents is changed when the cathode polarization voltage attains values outside the predetermined range of values.

A number of studies are reported in the published literature which relate to similar methods. C. L. Mantell et al (Trans. Met. Soc. of AIME, 236, 718–725, May 1966) determined the feasibility of current-potential curves as an analytical tool for monitoring manganese electrowinning solutions for metallic impurities. Polarization curves related to hydrogen evolution were shown to be sensitive to metallic impurities which affect the cathode surface thereby altering the hydrogen overvoltage. H. S. Jennings et al (Metallurgical Transactions, 4, 921–926, April 1973) describe a method for measuring cathodic polarization curves of copper sulfate solutions containing varying amounts of addition agents by varying an applied voltage and recording the relationship between voltage and current density. O. Vennesland et al (Acta Chem. Scand., 27, 3, 846–850, 1973) studied the effects of antimony, cobalt, and beta-naphthol concentrations in zinc sulfate electrolyte on the current-potential curve by changing the cathode potential at a programmed rate, recording the curves and comparing the curves with a standard. T. N. Anderson et al (Metallurgical Transactions B, 7B, 333–338, September 1976) discuss a method for measuring the concentration of glue in copper refinery electrolyte by determining polarization scan curves, which upon comparison provide a measure of glue concentration. B. A. Lamping et al (Metallurgical Transactions B, 7B, 551–558, December 1976) have investigated the use of cyclic voltammetry for the evaluation of zinc sulfate electrolytes. Cyclic voltammograms, which include the cathodic deposition as well as the anodic dissolution portions of the current-potential relationships, and polarization curves were recorded as a means for approximating the quantities of impurities and addition agents in zinc sulfate electrolytes.

This first group of references discloses methods wherein metal is deposited on an electrode and wherein current or, current density-potential curves represent cathode polarization potentials in relation to varying currents and/or current densities.

T. R. Ingraham et al (Can Met. Quarterly, 11, 2, 451–454, 1972) describe a meter for measuring the quality of zinc electrolytes by measuring the amount of cathodic hydrogen released during electrodeposition of zinc and indicating current efficiency by comparing the weight of deposited zinc with both the amount of zinc to be expected and the rate of hydrogen evolution. In U.S. Pat. No. 4,013,412, Satoshi Mukae, Mar. 22, 1977, there is disclosed a method for judging purity of purified zinc sulfate solution by subjecting a sample of solution to electrolysis, combusting generated gases and measuring the internal pressure in the combustion chamber which is an indirect measure of current efficiency. M. Maja et al (J. Electrochem. Soc., 118, 9, 1938–1540, 1971) and P. Benvenuti et al (La Metallurgia Italiana, 60, 5, 417–423, 1968) describe methods for detection of impurities and measuring the purity of zinc sulfate solutions by depositing zinc and then dissolving deposited zinc electrolytically and relating calculated current efficiency to impurity content.

This second group of references relates to methods and apparatus for determining electrolyte purity wherein electrolysis of solutions is used to determine current efficiency which is subsequently related to electrolyte purity.

SUMMARY OF THE INVENTION

I have now found that it is unnecessary to electrolyze solutions for electrodeposition for determining current efficiencies or to measure polarization potentials in relation to varying currents or current densities and that the correct degree of purification and the correct ratio between polarizing additive and impurity concentration in zinc sulfate electrolyte can be determined directly without electrolysis and at substantially zero current. Thus, I have found that the processes for the purification of zinc sulfate solutions and the electrowinning of zinc can be monitored by simply measuring the activation over-potential which occurs at substantially zero current flow immediately prior to deposition of zinc from zinc sulfate solutions in a test cell, whereby the values of the measured over-potential provide direct indication of whether the desired degree of purification is attained and whether the polarizing additive concentration is correct relative to the impurity concentration in the electrolyte and whereby the purification and electrowinning processes can be controlled to yield optimum current efficiency and level zinc deposits of high quality during electrowinning.

The method and apparatus of the invention apply to zinc sulfate solutions which are obtained in processes for the treatment of zinc containing materials such as ores, concentrates, etc. Treatment includes thermal treatments and hydrometallurgical treatments such as roasting, leaching, in situ leaching, bacterial leaching and pressure leaching. Such solutions which are referred to in this application as zinc sulfate solutions, zinc sulfate electrowinning solution or electrolyte, may be acidic or neutral solutions.

When zinc sulfate solution or electrolyte is subjected to a variable decreasing potential applied between electrodes placed in electrolyte in a cell, the potential measured against a standard reference electrode decreases through a range of potential values which are greater than the zinc reversible potential, i.e. the equilibrium voltage for zinc in the electrolyte. When the applied potential is decreased beyond the zinc reversible potential, the measured potential decreases through a second range of potential values which corresponds to the activation over-potential of zinc prior to deposition of zinc on the cathode. This second range of values ends at a potential value which corresponds to the point at which zinc starts to deposit and the measured current, or current density, increases rapidly from a value near zero for any further small decrease in potential. Beyond this point, the measured potential values represent cathode polarization voltages. The values of the activation over-potential can be used as a direct measure of the impurity concentration, i.e. the effectiveness of the purification process, and of the polarizing additive concentration relative to the impurity concentration in the electrolyte in the process for the recovery of zinc which includes the purification process and the electrowinning process. In response to measured values of the activation over-potential, the purification process can be adjusted, or the concentration of polarizing additive in the electrolyte can be adjusted relative to the impurity concentration and/or the impurity concentration can be adjusted, so that optimum current efficiency and level zinc deposits are obtained in the electrowinning process.

Accordingly, there is provided a method for controlling a process for the recovery of zinc from zinc sulfate electrowinning solutions containing concentrations of impurities, said method comprising the steps of establishing a test circuit comprising a test cell, a sample of electrowinning solution, a cathode, an anode and a reference electrode, said electrodes being immersed in said sample, a variable voltage source and measuring means electrically connected to said electrodes; applying a potential to the electrodes in said test cell to obtain a predetermined potential between said cathode and said reference electrode; decreasing the potential from said predeterined potential at a constant rate at substantially zero current, measuring the decreasing potential; terminating said decreasing of said potential at a value which corresponds to the point at which zinc starts to deposit on said cathode and the measured current increases rapidly from a value of substantially zero for any further small decrease in potential; determining the activation over-potential; relating said activation over-potential to the concentration of impurities in said sample; and adjusting the process for the recovery of zinc to obtain optimum recovery of zinc.

In another embodiment, the method includes controlling a process for the electrowinning of zinc from zinc sulfate electrowinning solutions containing concentrations of impurities and at least one polarizing additive, determining the activation over-potential according to the said method, relating said activation over-potential to the concentration ratio between impurities and additive in said sample and adjusting the concentration ratio in the electrowinning solutions to obtain optimum current efficiency and level zinc deposits in the electrowinning process.

DETAILED DESCRIPTION OF PREFERRED EMBODIMENT

The invention will now be described in detail. The apparatus used in the method for determining the activation over-potential of the zinc consists of a test circuit which comprises a test cell, a sample of zinc sulfate electrowinning solution or electrolyte, a cathode, an anode, a reference electrode, a variable voltage source and means for measuring the activation over-potential. The test cell is a small container of circular, square or rectangular cross-section made of a suitable material, which is preferably resistant to acid zinc sulfate electrolyte and large enough to hold a suitable sample of electrolyte. The three electrodes are removably positioned in the cell at constant distances from each other.

The cathode is made of aluminum and, upon immersion in the electrolyte sample in the cell, will have a determined surface area exposed to the electrolyte. I have determined that an exposed area of 1 $cm^2$ gives excellent results. The cathode is preferably made of aluminum foil contained in a cathode holder. The holder envelopes at least the immersed portion of the foil cathode except for the determined area which is to be exposed to electrolyte. The use of an aluminum foil cathode has a number of advantages. No special preparation of the foil surface is necessary, aluminum foil is readily available at low cost, test results are reproducible and the cathode can be readily replaced with a fresh one at the beginning of each test while the used cathode may be discarded. I have found that most household aluminum foils are suitable as they have a sufficiently smooth surface, and have electrochemical characteristics that give substantially zero current in the potential range when activation over-potentials are determined for zinc sulfate electrolyte. The suitability of foils can be tested by subjecting a sample of foil to the method of this invention by immersing the foil sample as a cathode in a solution containing, for example, 55 g/l zinc as zinc sulfate and 150 g/l sulfuric acid, and measuring any current over the range of voltages used in the test according to the method of the invention. Such a current should be less than an equivalent current density of about 0.4 mA/cm$^2$, preferably about 0.2 mA/cm$^2$.

The anode is made of a suitable material such as, for example, platinum of lead-silver alloy. I have found that anodes made of lead-silver alloy containing 0.75% silver are satisfactory. The references electrode can be a standard calomel electrode (SCE).

The three electrodes are electrically connected to the variable voltage source and to measuring means for voltages and currents. The variable voltage source is preferably a potentiostat, which preferably has a built-in ramp generator. The potentiostat enables control of the potential between the cathode and the anode as measured on the cathode relative to the SCE. The ramp generator makes it possible to change the potential at a constant rate and provides a control signal to the potentiostat. The potential from the potentiostat is measured using suitable measuring means which are connected in the test circuit as required to ensure proper functioning. The measured potential may, for example, be recorded in the form of a line or trace as a function of current. Alternatively, current may be recorded only, but as a function of time. In both cases, the value of the current will be substantially zero until the point is reached at which zinc starts to deposit on the cathode, from which point the current will no longer be substantially zero. If desired, current may be recorded by a meter or other suitable read-out instrument, which will similarly record a value of substantially zero current until zinc starts to deposit, after which current values will be recorded. The electrodes are removably positioned in the cell in fixed relation to each other. I have found that good results are obtained when the cathode surface area exposed to electrolyte is kept at a fixed distance of about 4 cm from the surface of the anode and when the SCE is positioned between the cathode and the anode in such a way that the tip of the SCE is rigidly located at a distance of about 1 cm from but not covering the exposed surface area of the cathode.

Suitable means may be provided to maintain the electrolyte in the cell at a constant temperature. Such means may comprise a controlled heating/cooling coil placed in the test cell, or a constant temperature bath or the like.

In the method of the invention, a sample of zinc sulfate electro-winning solution or electrolyte, which may be neutral or acidic and which may contain added polarizing additive, e.g., animal glue, and may be obtained either from the purification process or from the zinc electrowinning process, is placed in the test cell, the sample is preferably adjusted to a certain zinc or zinc and acid content in order to reduce to a minimum any variation in the test method that may be caused by variations in zinc or zinc and acid concentrations in the electrolyte. The adjustment of the sample may be done before the sample is added to the test cell. Adjustment of zinc to, for example, 150 g/l zinc, or of zinc and acid, concentrations to, for example, 55 g/l zinc and 150 g/l sulfuric acid is satisfactory. However, concentrations in the range of 1 to 250 g/l zinc and 0 to 250 g/l sulfuric acid are equally satisfactory. A fresh aluminum foil cathode is placed in the cathode holder. Upon placing the coil in the holder, care must be taken to maintain a clean, smooth foil surface. The foil is placed in the holder such that either the dull or the shiny surface will be exposed to electrolyte and faces the anode. The use of one or the other of the surfaces should be consistent. The three electrodes are positioned in the cell at the predetermined fixed distances and are electrically connected to the potentiostat and to the voltage or current measuring means or both, whichever is applicable. Electrical connections between potentiostat, ramp generator and measuring means are usually retained permanently.

The temperature of the electrolyte being measured may be maintained constant. Changes in temperature affect the measured voltages, e.g., a decreasing temperature increases the measured voltages. If desired, the cell and its contents are adjusted to and maintained at a suitable, controlled, constant temperature, which may be between 0° and 100° C., preferably between 20° and 75° C. and, most preferably, in the range of 25° to 40° C. If desired, the constant temperature may be approximately the same as the temperature of the electrolyte in the electrowinning process or purification process, whichever is applicable. If the temperature is not maintained constant, the temperature change during measuring of the activation over-potential should be consistent from test to test so that the results of the tests are comparable.

The potentiostat is adjusted to provide a potential between the electrodes in order to obtain a predetermined potential between the cathode and the SCE, and the system is allowed to equilibrate for a period of sufficient duration. The value of the predetermined potential is chosen such that the measuring of the potentials can be performed within a reasonable time and without any unduly long equilibration time. A predetermined potential of −700 mV versus the SCE and an equilibration time of about 5 minutes yield the best reproducible results for the electrolytes tested. At the end of the equilibration period, the ramp generator is adjusted to decrease the potential from its initial value, i.e. the value of the predetermined potential, at a programmed rate expressed in mV/min. It is preferred that the rate of decrease be constant to obtain consistent and reliable values for the activation over-potential. If the rate is too slow, the test requires too much time; while, if the rate is too fast, the sensitivity of the test decreases below acceptable levels. A rate in the range of 5 to 500 mV/min is possible, but a rate in the range of 20 to 200 mV/min is preferred, with a rate of 100 mV/min being most preferred.

During the decreasing of the potential from its initial value of −700 mV versus the SCE, the measured values of the potential pass the value which corresponds to the value of the reversible zinc potential from which value the measured potentials represent values for the activation over-potential. Values for the activation over-potential increase in a further negative direction until the value is reached at which zinc starts to deposit on the cathode. Upon further decreasing of the potential, the measured potentials become polarization voltages and a current related to zinc deposition becomes measurable. In order to determine the correct value of the activation over-potential, the decreasing of the potential is allowed to continue until zinc starts to deposit which in practise is indicated by a sudden rapid increase in current from substantially zero current. For practical purposes the decreasing of potential is allowed to continue until an easily measurable current flow is indicated as may be shown on a recorded trace or visual read-out means. A current of a few milliamperes is satisfactory and a current corresponding to a current density of 0.4 $mA/cm^2$ was found to be a convenient end point to terminate the test. Thus, for easy, practical application of the method of this invention, the activation overpotential is expressed as the value of the measured potential at a current corresponding to a current density of 0.4 $mA/cm^2$. Upon reaching this value of current density, the test is completed and the value for the activation over-potential is determined. I have found it convenient to assign a value of zero to the measured value of the reversible zinc potential and to express the activation over-potential in positive values in millivolts.

The activation over-potential will have specific values dependent on the composition of the electrolyte. As every electrolyte composition can be purified to an optimum degree and as every electrolyte composition has an optimum range of polarizing additive contents, i.e. animal glue concentrations, relative to its impurity content, the activation over-potential will similarly have a range of values that is required to yield the desired optimum results. I have determined that increasing concentrations of impurities such as antimony, cobalt, nickel, germanium and copper cause a decrease in activation over-potential while increasing glue concentrations increase the over-potential.

If the value of the measured activation over-potential in the purification of electrolyte is too low, the impurity concentration is too high for optimum zinc recovery in the electrowinning process. Thus, dependent on the composition of the electrolyte, the activation overpotential is an indicator of the effectiveness of the purification process and deviations from optimum operation can be corrected by adjusting the purification process in relation to values of the activation over-potential, whereby the impurity concentration is lowered. Correction of the purification process may be accomplished, for example, by adjusting the temperature of the purification, adjusting the duration of the purification, increasing the amount of zinc dust, or increasing the concentration of a zinc dust activator such as antimony copper, or arsenic in ionic form. Alternatively, insufficiently purified electrolyte may be further purified in an additional purification step or by recirculation in the purification process.

If the value of the activation over-potential measured for the electrolyte in the electrowinning process is too low, the concentration of glue in the electrolyte is too low to adequately control cathodic zinc resolution caused by the impurities present, or the impurity concentration is too high relative to the concentration of glue. On the other hand, if the value is too high, the concentration of glue is too high relative to the impurity concentration, and a resultant loss in current efficiency and a rougher zinc deposit occur. Thus, depending on the composition of the electrolyte, the activation overpotential is an indicator of the efficiency of the electrowinning process and deviations from optimum operation can be corrected by changing the concentration of glue or the concentration of impurities in the electrolyte as required in relation to values of the activation overpotential. Change in the concentration of glue may be accomplished in a suitable manner such as by increasing or decreasing the rate of addition of glue to the electrolyte. A decrease in the impurity concentration may be achieved by more effective purification of the electrolyte prior to the electrowinning process. In the case of the presence of an excess concentration of glue, corrective action may also be taken by adding impurities to the electrolyte in a controlled fashion to bring the concentration ratio of impurities to glue to the correct value. Adding impurities is preferably done by controlled addition of antimony, which has the most economical effect in correcting the impurity to glue concentration ratio.

The method of the invention has a number of applications in the process for the recovery of zinc from zinc sulfate electrolyte. Thus, the method may be used before, during and after purification of zinc sulfate solution and before, during and after the electrowinning of zinc from zinc sulfate electrolyte. For example, prior to the zinc dust purification process, the method can be used to determine the degree of removal by iron hydroxide precipitation of impurities such as arsenic, antimony and germanium from zinc sulfate solutions obtained in the leaching of ores, concentrates or calcines. During purification, the method can be used to determine the degree of purification obtained, for example, with zinc dust, in the various steps of the purification process. After purification, the effectiveness of the purification can be determined as well as the possible need for adjustments to the purification process or to the subsequent electrowinning process. In the electrowinning process, the method can be advantageously used to determine the required amount of glue in relation to impurity concentration, the required amount of impurities, such as, for example, antimony, in relation to concentration of glue, the need for adjustments to the electrolyte feed, or to electrolyte in process and the quality of return acid.

EXAMPLES

The invention will now be described by means of the following non-limitative examples.

The method of the invention used in the following examples for determining the activation over-potential comprised placing a 500 ml sample of electrolyte in a test cell, immersing in the sample, in fixed position, a fresh aluminum foil cathode contained in a cathode holder allowing 1 $cm^2$ of the cathode to be exposed to electrolyte, a lead −0.75% silver anode and a SCE, positioned between the cathode and the anode the surface of the cathode being 4 cm away from that of the anode and the tip of the SCE being 1 cm from the cathode, such that the tip is not in direct line between the anode and the exposed surface area of the cathode heating or cooling the sample to the desired temperature, connecting the electrodes to a potentiostat with ramp generator and an x-y recorder, applying an initial potential to obtain the predetermined potential of −700 mV versus the SCE, equilibrating the system for 5 minutes, adjusting the ramp generator to decrease the potential at a rate of 100 mV/min., continuously recording the measured potential against current, continuing the decrease in potential until the recorded current showed a value equivalent to 0.4 $mA/cm^2$, terminating the test and reading from the record the value for the activation over-potential in mV.

EXAMPLE 1

Identical samples of electrolyte containing 55 g/l zinc, 150 g/l sulfuric acid, 0.04 mg/l Sb, 0.03 mg/l Cu, 0.1 mg/l Co, 0.1 mg/l Ni, 0.005 mg/l Ge, 0.5 mg/l Cd, 30 mg/l Cl, 2 mg/l F and 10 mg/l glue, were used to determine the effect of varying rates of the decreasing measured potentials on the value of the activation over-potential of zinc. The tests were carried out using the described method. The temperature of the samples was maintained at 35°±0.5° C. In order to measure the end point of the test, the potentials were measured until a current equivalent to a current density of 0.4 mA/cm$^2$ was obtained. The measured potentials were recorded against current density for rates of 5, 20, 100, 200 and 500 mV/min. Values for the over-potential at 0.4 mA/cm$^2$ were 85, 90, 98, 106 and 122 mV respectively.

At a rate of 5 mV/min, measurable current was obtained throughout the test. Although an end point of about 85 mV could be determined at which zinc started to deposit, the value for the activation over-potential would not be reliable, while, moreover, the duration of the test is too long. At high rates, such as 500 mV/min, the end point of the test became less distinct as small changes in the system resulted in large changes in the values of the potential. Rates in the range of 20 to 200 mV/min gave relatively "sharp" end points and are satisfactory for the tests according to the invention, the results were reproducible and the tests were completed within a reasonable length of time. At the most preferred rate of 100 mV/min, the test was completed in 15 minutes.

EXAMPLE 2

This example illustrates the effects of the presence in zinc electrolyte of varying amounts of different impurities on the value on the activation over-potential. A quantity of neutral, purified plant electrolyte was analyzed and found to contain 150 g/l zinc, 0.01 mg/l Sb, 0.1 mg/l Cu, 0.2 mg/l Co, 0.005 mg/l Ge, 0.5 mg/l Cd, 69 mg/l Cl and 3 mg/l F. The quantity of electrolyte was divided into 500 ml samples to each of which was added an amount of antimony and/or other impurities. Each sample was added to the cell, heated to 35° C., maintained at this temperature during the test and the activation over-potential was determined using the method as described. Each sample was then adjusted to 50 g/l zinc and 150 g/l $H_2SO_4$, maintained at 35° C. and the activation over-potential was measured in the acidified electrolyte at this temperature. Some of the samples were subsequently further cooled to 25° C. and the measurement of the activation over-potential was repeated. The results are tabulated in Table I.

Table I

| additions in mg/l to neutral electrolyte | | | | | activation over-potential in mV | | |
|---|---|---|---|---|---|---|---|
| | | | | | neutral electrolyte | acidified electrolyte | acidified electrolyte |
| Sb | Co | Cd | Cu | Other | at 35° C. | at 35° C. | at 25° C. |
| 0 | 0 | 0 | 0 | 0 | 89 | 73 | 96 |
| 0.005 | — | — | — | — | 87 | 61 | 70 |
| 0.01 | — | — | — | — | 79 | 56 | 58 |
| 0.02 | — | — | — | — | 76 | 54 | 55 |
| 0.04 | — | — | — | — | 67 | 55 | — |
| 0.06 | — | — | — | — | 57 | 52 | — |
| 0 | 0.3 | — | — | — | 86 | 74 | 98 |
| 0 | 0.8 | — | — | — | 88 | 68 | 94 |
| 0.02 | 0.3 | — | — | — | 77 | 59 | 59 |
| 0.02 | 0.8 | — | — | — | 76 | 56 | 57 |
| 0.06 | 0.3 | — | — | — | 57 | 53 | — |
| 0.06 | 0.8 | — | — | — | 53 | 48 | — |
| 0.02 | 0.3 | 1 | — | — | 76 | 60 | — |
| 0.02 | 0.3 | 2 | — | — | 71 | 55 | — |
| 0.02 | 0.3 | 10 | — | — | 66 | 57 | — |
| 0.02 | 0.3 | 2 | 0.5 | — | 71 | 53 | — |
| 0.02 | 0.3 | 2 | 2 | — | 62 | 52 | — |
| 0.02 | 0.3 | 2 | 10 | — | 55 | 49 | — |
| — | — | 2 | — | — | 92 | 77 | — |
| — | — | — | 2 | — | 87 | 64 | 92 |
| — | — | — | — | Ni = 2 | 89 | 74 | 96 |
| — | — | — | — | Ni = 10 | — | — | 74 |
| — | — | — | — | Cl = 100 | 82 | 68 | 97 |
| — | — | — | — | F = 50 | 79 | 58 | 83 |
| — | — | — | — | Ge = 0.002 | — | — | 80 |

The results in Table I show that values for the activation over-potential decrease with increasing concentrations of impurities in electrolyte and that the decrease in the values for the over-potential in neutral electrolyte is greater than that in the same electrolyte that has been acidified. (The adjustment in zinc content of the electrolyte from 150 to 50 g/l caused a corresponding dilution in the concentrations of the impurities.) The results also show the effect of temperature and clearly indicate the desirability of carrying out the measuring of the over-potential at a substantially constant temperature.

EXAMPLE 3

This example illustrates the effects of the presence in zinc electrolyte of varying amounts of different impurities and amounts of animal glue varying from 4 to 400 mg/l on the value of the activation over-potential. A quantity of plant electrolyte was analyzed and adjusted to 55 g/l zinc and 150 g/l sulfuric acid. The adjusted electrolyte also contained 0.01 mg/l Sb, 0.03 mg/l Cu, 0.1 mg/l Co, 0.1 mg/l Ni, 0.005 mg/l Ge, 0.5 mg/l Cd, 30 mg/l Cl and 2 mg/l F. The quantity of adjusted electrolyte was divided into 500 ml samples to each of which was added an amount of glue and antimony and/or other impurities. Each sample was added to the cell, heated to 25° C., maintained at this temperature during the test and the activation over-potential was determined using the method as described. The results are tabulated in Table II.

TABLE II

| additions in mg/l | | | activation over-potential | additions in mg/l | | | activation over-potential |
|---|---|---|---|---|---|---|---|
| glue | Sb | other | in mV at 25° C. | glue | Sb | other | in mV at 25° C. |
| 5 | 0 | — | 130 | 50 | 0.04 | — | 128 |
| 10 | 0 | — | 143 | 8 | 0.08 | — | 70 |
| 20 | 0 | — | 158 | 16 | 0.08 | — | 81 |
| 50 | 0 | — | 181 | 30 | 0.08 | — | 98 |
| 400 | 0 | — | 224 | 50 | 0.08 | — | 119 |
| 4 | 0.01 | — | 82 | 20 | 0 | Co = 0.4 | 135 |
| 8 | 0.01 | — | 99 | 50 | 0.02 | Co = 0.4 | 140 |

TABLE II-continued

| additions in mg/1 | | | activation over-potential | additions in mg/1 | | | activation over-potential |
|---|---|---|---|---|---|---|---|
| glue | Sb | other | in mV at 25° C. | glue | Sb | other | in mV at 25° C. |
| 16 | 0.01 | — | 105 | 50 | 0.02 | Co = 4.9 | 130 |
| 30 | 0.01 | — | 125 | 15 | 0.02 | Cu = 2 | 83 |
| 4 | 0.02 | — | 95 | 15 | 0.02 | Cu = 4 | 70 |
| 8 | 0.02 | — | 98 | 30 | 0.02 | Cu = 4 | 107 |
| 16 | 0.02 | — | 107 | 20 | 0 | Ni = 10 | 120 |
| 30 | 0.02 | — | 120 | 20 | 0 | Ge = 0.002 | 150 |
| 50 | 0.02 | — | 134 | 5 | 0 | F = 10 | 127 |
| 8 | 0.04 | — | 77 | 5 | 0 | F = 50 | 116 |
| 16 | 0.04 | — | 90 | 5 | 0 | F = 100 | 100 |
| 30 | 0.04 | — | 107 | | | | |

The results in Table II clearly show that increasing concentrations of impurities in acid zinc sulfate electrolyte decrease the activation over-potential of zinc and that additions of glue to the electrolyte increase the over-potential.

EXAMPLE 4

This example illustrates that increasing concentrations of glue are required to give good current efficiency when increasing impurity concentrations are present in electrolyte and that optimum ranges for glue concentrations in relation to impurity concentrations exist to give highest current efficiencies. Samples of adjusted plant electrolyte as used in Example 3, to which varying amounts of glue and antimony and/or cobalt were added as potassium antimony tartrate and cobalt sulfate, respectively, were subjected to electrolysis in a cell at a current density of 400 A/m$^2$ at 35° C. for 24 hours. The current efficiencies for the zinc deposition were determined by determining the ratio of the weight of the deposited zinc to the calculated weight based on the total amount of current passed through the cell for the deposition of zinc. The results are given in Table III.

Table III

| glue added in mg/1 | | 0 | 10 | 15 | 20 | 25 | 30 | 40 | 45 | 50 |
|---|---|---|---|---|---|---|---|---|---|---|
| Sb added in mg/1 | Co added in mg/1 | current efficiencies in % | | | | | | | | |
| 0.01 | 0 | 88 | 92 | 91 | 90 | 89 | 88 | 87 | 87 | 85 |
| 0.03 | 0 | 79 | 90 | 92 | 93 | 92 | 91 | 89 | 88 | 87 |
| 0.05 | 0 | 56 | 86 | 90 | 92 | 93 | 93 | 92 | 91 | 88 |
| 0.07 | 0 | 43 | 72 | 81 | 85 | 89 | 92 | 93 | 92 | 89 |
| 0.01 | 0.05 | 89 | 92 | 92 | 91 | 90 | 89 | 88 | 87 | 85 |
| 0.01 | 2 | 88 | 92 | 92 | 92 | 92 | 91 | 91 | 90 | 89 |
| 0.01 | 5 | 65 | 87 | 92 | 92 | 92 | 92 | 92 | 92 | 91 |
| 0.01 | 5* | — | 43 | 74 | 82 | 82 | 81 | 79 | 77 | 75 |
| 0.03 | 0.05 | 80 | 90 | 92 | 93 | 93 | 91 | 90 | 88 | 86 |
| 0.03 | 1 | 40 | 74 | 85 | 92 | 94 | 93 | 92 | 91 | 89 |
| 0.03 | 5 | — | 58 | 74 | 87 | 92 | 94 | 94 | 93 | 90 |
| 0.03 | 5* | — | — | — | 40 | 72 | 82 | 83 | 83 | 78 |

*48 hour deposit

It is evident from the tabulated results that for each antimony concentration, a corresponding narrow range of glue concentrations was required to give the highest possible current efficiencies. Current efficiencies decreased for both deficient and excessive glue concentrations. Thus, a range of optimum glue concentrations exists for each antimony concentration. Similarly, when antimony and cobalt are present, glue additions are required to counteract the harmful effects of these impurities and optimum glue concentrations exist for each antimony and cobalt concentration. The optimum glue concentrations were the same for 48 hour as for 24 hour deposits, but the current efficiencies had decreased.

EXAMPLE 5

Values for the activation over-potential for glue and impurities concentrations obtained in tests as illustrated in Examples 2 and 3 and Tables I and II were combined with ranges of maximum current efficiencies for combinations of concentrations of glue and impurities obtained in tests as illustrated in Example 4 and Table III. Thus, the following ranges of values for optimum current efficiency were obtained in relation to ratios between glue and impurities as indicated by the values of the activation over-potential measured at 25° C. The ranges are tabulated in Table IV.

TABLE IV

| activation over-potential in mV | range of current efficiency in % |
|---|---|
| 80 | 75–83 |
| 85 | 79–86 |
| 90 | 83–89 |
| 95 | 86–91 |
| 100 | 88–93 |
| 105 | 90–94 |
| 110 | 90–94 |
| 115 | 89–93 |
| 120 | 87–92 |
| 125 | 86–89 |
| 130 | 83–87 |

It can be seen from the tabulated figures that the highest ranges of current efficiencies are obtained when the activation over-potential is maintained in the range of 95 to 120 mV, measured 25° C.

EXAMPLE 6

This example illustrates how the activation over-potential measurements can be used to determine if the correct glue concentration is present in the electrolyte relative to the impurity concentration and what changes are required in glue concentration to optimize the zinc electrowinning process. The example also illustrates the effect of temperature on over-potential, when results are compared with those of Example 5. Using the same electrolyte as used in previous examples, tests as described in Example 3 were repeated at 35° C., current efficiencies were determined as in Example 4 and the results combined as illustrated in Example 5. Maximum values for current efficiency were obtained for over-potentials in the range of 115 to 130 mV. Using the results of the tests according to this example, the required change in glue concentration in mg/l was determined at measured values for the activation over-potential (35° C.) to obtain the optimum value for the current efficiency in the electrolytic process. Data presented in Table V show the program to control the electrowinning process for zinc by making specified changes in glue concentration in zinc electrolyte.

TABLE V

| Measured Activation Over-potential in mV at 35° C. | Required Change in Glue Concentration in mg/l for Optimum Current Efficiency |
|---|---|
| 95 | increase by 9 |
| 100 | increase by 7 |
| 105 | increase by 5 |
| 110 | increase by 3 |
| 115 | increase by 1 |
| 120 | no change |
| 125 | no change |
| 130 | decrease by 1 |
| 135 | decrease by 3 |
| 140 | decrease by 5 |
| 145 | decrease by 7 |
| 150 | decrease by 9 |

EXAMPLE 7

An electrowinning plant using electrolyte containing 55 g/l Zn, 150 g/l $H_2SO_4$, 0.02–0.05 mg/l Sb, 0.1–0.5 mg/l Co, 0.05–0.15 mg/l Cu, 0.1–0.3 mg/l Ni, 0.01–0.05 mg/l Ge, 0.1–0.5 mg/l Cd, 60 mg/l Cl and 2–5 mg/l F, and 13 mg/l glue was monitored over a period of 14 days and daily current efficiencies were determined. The current efficiency varied between 91.6 and 99.3%, the average being 97.6%. Over a second period of 10 days the activation over-potential in electrolyte samples was determined at 35° C. and the concentration of glue in the electrolyte adjusted according to the data presented in Table V. Current efficiencies ranged from 97.1 to 99.2%, the average being 98.2%. The results of using control over the electrolytic process by using the activation over-potential test are obvious.

EXAMPLE 8

This example illustrates that a changed composition of electrolyte gives different values for the activation over-potentials which yield optimum current efficiencies and that a correspondingly different program should be used to control the electrolysis using the changed electrolyte. Using samples of electrolyte containing 40–45 g/l Zn, 130–135 g/l $H_2SO_4$, 0.08–0.2 mg/l Sb, 0.1–0.3 mg/l Cu, 0.5–3 mg/l Cd, 0.1–0.5 mg/l Co, 0.1–0.5 mg/l Ni, 0.01–0.05 mg/l Ge, 200–250 mg/l Cl and 250–400 mg/l F, the electrolyte was adjusted to 45 g/l Zn, 130 g/l $H_2SO_4$ and 400 mg/l F. Activation over-potentials, current efficiencies and glue additions to obtain optimum conditions were determined similar to determinations according to Example 6. The control program is given in Table VI. Optimum values for current efficiencies are attained with activation over-potentials of 95–100 mV measured at 35° C.

TABLE VI

| Measured Activation Over-potential in mV at 35° C. | Required Change in Glue Concentration in mg/1 for Optimum Current Efficiency |
|---|---|
| 70 | increase by 9 |
| 75 | increase by 7 |
| 80 | increase by 5 |
| 85 | increase by 3 |
| 90 | increase by 1 |
| 95 | no change |
| 100 | no change |
| 105 | decrease by 1 |

TABLE VI-continued

| Measured Activation Over-potential in mV at 35° C. | Required Change in Glue Concentration in mg/1 for Optimum Current Efficiency |
|---|---|
| 110 | decrease by 3 |
| 115 | decrease by 5 |
| 120 | decrease by 7 |
| 125 | decrease by 9 |

EXAMPLE 9

This example illustrates that antimony can be used in relation to measured values of the activation over-potential to control the zinc electrowinning process at optimum current efficiency.

In a series of electrowinning cells using an acidic zinc sulfate electrolyte, having the adjusted composition as given in Example 3, both glue and antimony are added. Glue is added to the electrolyte at a constant rate of 20 mg/l, while antimony is normally added at a rate of 0.04 mg/l.

Using the electrolyte and the above mentioned additions of glue and antimony, activation over-potentials and current efficiencies were determined as in Example 6. Optimum values for current efficiencies were attained with activation over-potentials of 120 to 125 mV measured at 35° C. Using the results of these determinations, the required changes in antimony concentrations in the electrolyte in mg/l were determined at measured values for the activation over-potential to obtain the optimum value for the current efficiency in the electrolytic process. The control program is given in Table VII.

TABLE VII

| Measured Activation Over-potential in mV at 35° C. | Required Change in Antimony Concentration in mg/l for Optimum Current Efficiency |
|---|---|
| 105 | decrease by 0.03 |
| 110 | decrease by 0.02 |
| 115 | decrease by 0.01 |
| 120 | no change |
| 125 | no change |
| 130 | increase by 0.01 |
| 135 | increase by 0.02 |
| 140 | increase by 0.03 |

EXAMPLE 10

This example illustrates that the removal of impurities from neutral zinc electrolyte by cementation with atomized zinc can be monitored by activation over-potential measurements. Samples of 500 ml of impure plant electrolyte were subjected to purification with atomized zinc added to electrolyte containing previously added antimony as antimony potassium tartrate. Cementation was carried out for one hour at 50° C. in agitated solutions. At the end of one hour, the samples were filtered hot and a portion of the samples was assayed. One test was carried out at 75° C., and one for only 15 minutes. The activation over-potential was determined at 35° C. in the remaining portion of the samples. The samples were then adjusted to 50 g/l Zinc and 150 g/l $H_2SO_4$ and the activation over-potentials were redetermined. The results are tabulated in Table VIII. Also tabulated in Table VIII are the results for a purified neutral zinc solution obtained from an industrial zinc plant.

TABLE VIII

| Purification Time in min | Electrolyte Temperature in °C. | Sb Added in mg/l | Atomized Zinc Added in g/l | Activation over-potential in mV at 35° C. neutral | acidified | Impurities in Final Electrolyte in mg/l Cd | Cu | Co | Ni | Sb |
|---|---|---|---|---|---|---|---|---|---|---|
| 60 | 50 | 0.75 | 0 | 34 | 30 | 200 | 3.5 | 1.6 | 1.8 | 0.75 |
| 60 | 50 | 0.75 | 0.5 | 48 | 44 | 21 | 4.1 | 0.3 | 0.9 | 0.09 |
| 60 | 50 | 0.75 | 1.0 | 64 | 53 | 12 | 3.4 | 0.3 | 0.5 | 0.05 |
| 60 | 50 | 0.75 | 1.5 | 74 | 59 | 3.9 | 1.3 | 0.2 | 0.6 | 0.04 |
| 60 | 50 | 0.75 | 2.0 | 76 | 60 | 1.9 | 1.0 | 0.2 | 0.4 | 0.03 |
| 60 | 50 | 0.75 | 2.5 | 88 | 64 | 0.4 | 0.8 | 0.3 | 0.3 | 0.03 |
| 60 | 50 | 0.75 | 3.0 | 94 | 68 | 0.3 | 0.6 | 0.2 | 0.2 | 0.02 |
| 60 | 50 | 0.25 | 2.0 | 70 | 54 | 2.2 | 0.5 | 0.2 | <0.1 | 0.07 |
| 60 | 50 | 0.50 | 2.0 | 74 | 58 | 2.2 | 0.6 | 0.1 | 0.1 | 0.03 |
| 60 | 50 | 1.00 | 2.0 | 85 | 62 | 0.6 | 0.6 | 0.1 | <0.1 | 0.02 |
| 15 | 50 | 0.75 | 3.0 | 48 | 43 | 26 | — | — | — | — |
| 60 | 75 | 0.75 | 0.5 | 84 | 64 | 1.8 | — | — | — | — |
| Plant Purified Solution | | | | 98 | 71 | 0.5 | 0.1 | 0.2 | 0.2 | 0.01 |

EXAMPLE 11

This example illustrates how the activation over-potential measurements such as those given in Table VIII can be used to determine what corrections must be made to the process for controlling variables such as zinc dust and antimony additions to optimize the zinc dust purification of electrolyte. Data presented in Table IX show the program to control the zinc dust purification process by making specified changes in the zinc dust or antimony salt additions to the zinc electrolyte during purification if the measured activation over-potentials indicate purification has not proceeded to completion.

TABLE IX

| Measured Activation Over-potential in mV at 35° C. for neutral Electrolyte | Required Additions of Zinc Dust (g/l) | Sb (mg/l) |
|---|---|---|
| 100 | 0 | 0 |
| 95 | 0 | 0 |
| 90 | 0.3 | 0.1 |
| 85 | 0.6 | 0.2 |
| 80 | 0.9 | 0.3 |
| 75 | 1.2 | 0.4 |
| 70 | 1.5 | 0.5 |
| 65 | 1.8 | 0.5 |
| 60 | 2.1 | 0.5 |

What we claim as our invention is:

1. A method for controlling a process for the recovery of zinc from a zinc sulfate electrowinning solution containing concentrations of impurities, said method comprising the steps of (a) establishing a test circuit comprising a test cell, a sample of electrowinning solution, a cathode, an anode and a reference electrode, said electrodes being immersed in said sample, a variable voltage source and measuring means electrically connected to said electrodes;

(b) applying a potential to the electrodes in said test cell to obtain a predetermined potential between said cathode and said reference electrode;

(c) decreasing the potential from said predetermined potential at a constant rate at substantially zero current;

(d) measuring the decreasing potential;

(e) terminating said decreasing of said potential at a value which corresponds to the point at which zinc starts to deposit on the cathode and the measured current increases rapidly from a value of substantially zero for any further small decrease in potential;

(f) determining the activation over-potential;

(g) relating said activation over-potential to the concentration of impurities in said sample; and (h) adjusting the process for the recovery of zinc to obtain optimum recovery of zinc.

2. A method as defined in claim 1, wherein said process for the recovery of zinc includes purification of zinc sulfate electrowinning solution and wherein said adjusting comprises adjusting the concentration of antimony in said solution during purification.

3. A method as defined in claim 2, wherein said adjusting is carried out when the value of the activation over-potential measured at a temperature of between 25° C. and 40° C. is less than 90 milliVolts.

4. A method as defined in claim 1, wherein said process for the recovery of zinc includes purification of zinc sulfate electrowinning solution and wherein said adjusting comprises correction of the purification process.

5. A method as defined in claim 1, wherein said process for the recovery of zinc includes purification of zinc sulfate electrowinning solution by addition of zinc dust and wherein said adjusting comprises adjusting the amount of zinc dust added during said purification.

6. A method as defined in claim 1, wherein said process for the recovery of zinc includes purification of zinc sulfate electrowinning solution, wherein said adjusting comprises at least one of (a) adjusting the amount of zinc dust added during purification, (b) adjusting the concentration in solution of at least one of the group consisting of antimony, copper and arsenic, (c) adjusting the temperature of the purification, and (d) adjusting the duration of the purification, said adjusting being carried out when the value of the activation over-potential measured at a temperature of between 25° C. and 40° C. is less than 90 milliVolts; and wherein the activation over-potential is measured from the value of the reversible zinc potential to a value at which the current corresponds to a current density of 0.4 mA/cm$^2$.

7. A method for controlling a process for the electrowinning of zinc from an acidic zinc sulfate electrowinning solution containing concentrations of impurities and at least one polarizing additive, said method comprising the steps of (a) establishing an electrolytic test circuit comprising a test cell, a sample of electrowinning solution, a cathode, an anode and a reference electrode, said electrodes being immersed in said sample, a variable voltage source and measuring means electrically connected to said electrodes applying a potential to the electrodes in said test cell to obtain a predetermined potential between said cathode and said reference electrode;

(b) decreasing the potential from said predetermined potential at a constant rate at substantially zero current;

(c) measuring the decreasing potential;

(d) terminating said decreasing of said potential at a value which corresponds to the point at which zinc starts to deposit on the cathode and the measured current increases rapidly from a value of substantially zero for any further small decrease in potential;

(e) determining the activation over-potential;

(f) relating said activation over-potential to the concentration ratio between impurities and additive in said sample; and (g) adjusting the concentration ratio in the electrowinning solution to obtain optimum current efficiency and level zinc deposits in the electrowinning process.

8. A method as defined in claim 1, or 7, wherein the electrolyte in the test cell is kept at a substantially constant temperature.

9. A method as defined in claim 8, wherein the constant temperature selected is between 20° C. and 75° C.

10. A method as defined in claim 8, wherein the constant temperature selected is between 25° and 40° C.

11. A method as defined in claim 8, in which the constant temperature is selected to be substantially the same as the temperature of the electro-winning solution employed in the process.

12. A method as defined in claim 7, wherein the polarizing additive is animal glue.

13. A method as defined in claim 12, in which the adjusting of the concentration ratio comprises adjusting the concentration of the glue relative to the impurity concentration.

14. A method as defined in claim 12, wherein the concentration ratio is adjusted by adjusting the concentration of glue to a value at which the activation over-potential measured at a temperature of between 25° C. and 40° C. is in the range of 70 to 150 milliVolts.

15. A method as defined in claim 12, wherein the concentration ratio is adjusted by adjusting the concentration of glue to a value at which the activation over-potential measured at a temperature of between 25° C. and 40° C. is in the range of 70 to 150 milliVolts; and wherein the activation over-potential is measured from the value of the reversible zinc potential to a value at which the current corresponds to a current density of 0.4 $mA/cm^2$.

16. A method as defined in claim 1, or 7, wherein the cathode in the test cell is made from aluminum foil.

17. A method as defined in claim 7, wherein the adjusting of the concentration ratio comprises adjusting the concentration of the polarizing additive relative to the impurity concentration.

18. A method as defined in claim 7, wherein the adjusting of the concentration ratio comprises adjusting the impurity concentration.

19. A method as defined in claim 1, or 7, in which the potential is decreased at a constant rate in the range of 20 to 200 milliVolts per minute.

20. A method as defined in claim 1, or 7, in which the potential is decreased at a rate of substantially 100 milliVolts per minute.

21. A method as defined in claim 7, wherein the adjusting of the concentration ratio comprises adjusting the impurity concentration by adjusting the concentration of antimony.

22. A method as defined in claim 1, or 7, in which the electrodes are removably positioned in the cell in fixed relation to one another.

23. A method as defined in claim 1, or 7, wherein the cathode in the test cell is made from aluminum foil, and the aluminum foil is replaced by fresh foil at the beginning of each test.

24. A method as defined in claim 1, or 7, wherein the measuring of the decreasing potential is effected by recording the said potential as a function of current.

* * * * *